US005932076A

United States Patent [19]

Gubig

[11] Patent Number: 5,932,076

[45] Date of Patent: Aug. 3, 1999

[54] ELECTROFORMING APPARATUS

[75] Inventor: Andreas Gubig, Gütersloh, Germany

[73] Assignee: Technotrans GmbH, Sassenberg, Germany

[21] Appl. No.: 08/912,666

[22] Filed: Aug. 18, 1997

[30] Foreign Application Priority Data

Jan. 23, 1997 [DE] Germany ..... 297 01 092 U

[51] Int. Cl.[6] ..... C25D 17/00

[52] U.S. Cl. ..... 204/212; 204/224 R; 204/273; 204/275

[58] Field of Search ..... 204/212, 224 R, 204/273, 275

[56] References Cited

U.S. PATENT DOCUMENTS

| | | | |
|---|---|---|---|
| 3,536,594 | 10/1970 | Pritchard . | |
| 4,359,375 | 11/1982 | Smith | 204/212 |
| 4,391,694 | 7/1983 | Runsten | 204/273 |
| 4,415,423 | 11/1983 | Brooks | 204/273 X |
| 4,539,079 | 9/1985 | Okabayashi | 204/212 X |
| 5,597,460 | 1/1997 | Reynolds | 204/273 X |

OTHER PUBLICATIONS

Patent Abstracts of Japan 62–116800 A., C–455, Oct. 29, 1987, vol. 11, No. 332.

Patent Abstracts of Japan 6–17291 A., C–1194, Apr. 25, 1994, vol. 18, No. 226.

*Primary Examiner*—Donald R. Valentine

*Attorney, Agent, or Firm*—Griffin, Butler, Whisenhunt & Szipl, LLP

[57] ABSTRACT

An electroforming apparatus, in particular for the manufacture of CD/LD data media molding tools, comprises an anode assembly and a rotatable cathode assembly spaced therefrom, and a stationary nozzle means for ejecting an electrolytic fluid into the space between the anode and cathode assemblies. An annular part of the cathode assembly surrounding a molding tool blank is penetrated by a plurality of circumferentially distributed flow passages, the inlet ends thereof are disposed to successively come into alignment with the nozzle means upon rotation of the cathode assembly so that the electrolytic fluid ejected from the nozzle means is received by the flow passages and guided thereby into the space between the anode and cathode assemblies. The width of the spac can thereby substantially be minimized.

7 Claims, 2 Drawing Sheets

ELECTROFORMING APPARATUS

The invention relates to an electroforming apparatus and in particular to an electroforming apparatus for the manufacture of CD/LD data media moulding tools.

BACKGROUND OF THE INVENTION

In an electroforming apparatus of a type described above, it is customary to provide a nozzle means in a space between a rotatable cathode platen or disc adapted to support a moulding tool blank and an anode basket for ejecting an electrolytic fluid uniformly onto the blank to be coated. Accordingly, the spacing between the cathode platen and the anode basket is basically determined by the amount of space required for the nozzle means. The electrolytic fluid introduced between the cathode platen and the anode basket serves as a conductive medium for ion migration caused by the electrical potential applied to the anode basket and the cathode platen. Thus, the greater the spacing between the anode basket and the cathode platen, the greater the electrical resistance caused by the electrolytic fluid, this then correspondingly influencing the migration of ions and hence the thickness of the layer provided on the blank that can be achieved per unit of time. On the other hand, the electrical potential cannot be arbitrarily increased for overcoming the electrical resistance since dissolution phenomena will occur at the anode basket above an upper limit of the voltage, e.g. about 20 volts. Accordingly a reduction of the spacing between the anode basket and the cathode platen is principally desirable in order to reduce the electrical resistance between these parts, which would permit higher current intensities for a same value of voltage, resulting in a corresponding shortening of the processing time. Furthermore, a reduction of the spacing between the anode basket and the cathode platen would result in a more uniform distribution in the thickness of the layer.

An object of the invention therefore is to provide an electroforming apparatus having minimized spacing between the cathode and anode assemblies. Another object is to provide an electroforming apparatus having minimized spacing between the cathode and anode assemblies without this being detrimental to the distribution of the electrolytic fluid along the cathode assembly or to the rotation thereof.

SUMMARY OF THE INVENTION

These objects are achieved in accordance with the present invention by an electroforming apparatus including an anode assembly and a rotatable cathode assembly spaced from each other, and a stationary nozzle means for ejecting an electrolytic fluid for introducing it between the anode and cathode assemblies for coating a moulding tool blank mounted on the cathode assembly, wherein a plurality of circumferentially distributed flow passages extend through an annular part of the cathode assembly, said annular part circumferentially surrounding the moulding tool blank, said flow passages having inlet and outlet ends, in which said inlet ends being disposed with respect to said nozzle means for coming successively into alignment therewith upon rotation of the cathode assembly so that the electrolytic fluid ejected from the nozzle means is substantially accomodated by the flow passages for guiding the electrolytic fluid via the flow passages into the space between the anode and cathode assemblies.

Accordingly, in accordance with the present invention the nozzle means hitherto disposed in a wide space between the cathode and anode assemblies is transferred to a location along the outer periphery of the cathode assembly so that the spacing between the cathode and anode assemblies can be reduced by the amount of space previously required for the nozzle means accommodated therein. However, simply transferring the nozzle means to a location near the outer periphery of the cathode assembly would not be sufficient since it would result in an inadequate supply of electrolytic fluid between the cathode and anode assemblies. Consequently, an annular part encompassing the moulding tool blank is provided on the cathode assembly through which a plurality of circumferentially spaced flow passages extend from the outside to the inside of the annular part. These flow passages have the task of receiving the electrolytic fluid ejected from the nozzle means and guiding it into the space between the cathode and anode assemblies which thereby can significantly be reduced in its thickness. It has been found that the electrolytic fluid supplied via the flow passages is distributed substantially more uniformly over the surface of the moulding tool blank than it is possible with a nozzle means disposed in a conventional manner so that not only an increase in the electrical current intensity is possible as a result of the reduced electrical resistance of the electrolytic fluid in the narrow space but also can be achieved a substantial improvement in the thickness distribution of the layer and the quality of the deposition. Due to the possibility of carrying out the process at higher current strength, shorter processing times and hence increased production rates of moulding tools for the manufacture of CD/LD data media are obtained.

BRIEF DESCRIPTION OF THE DRAWINGS

The invention will be explained in more detail hereinafter with reference to the drawings, in which.

DETAILED DESCRIPTION OF THE DRAWINGS

Figure 1:
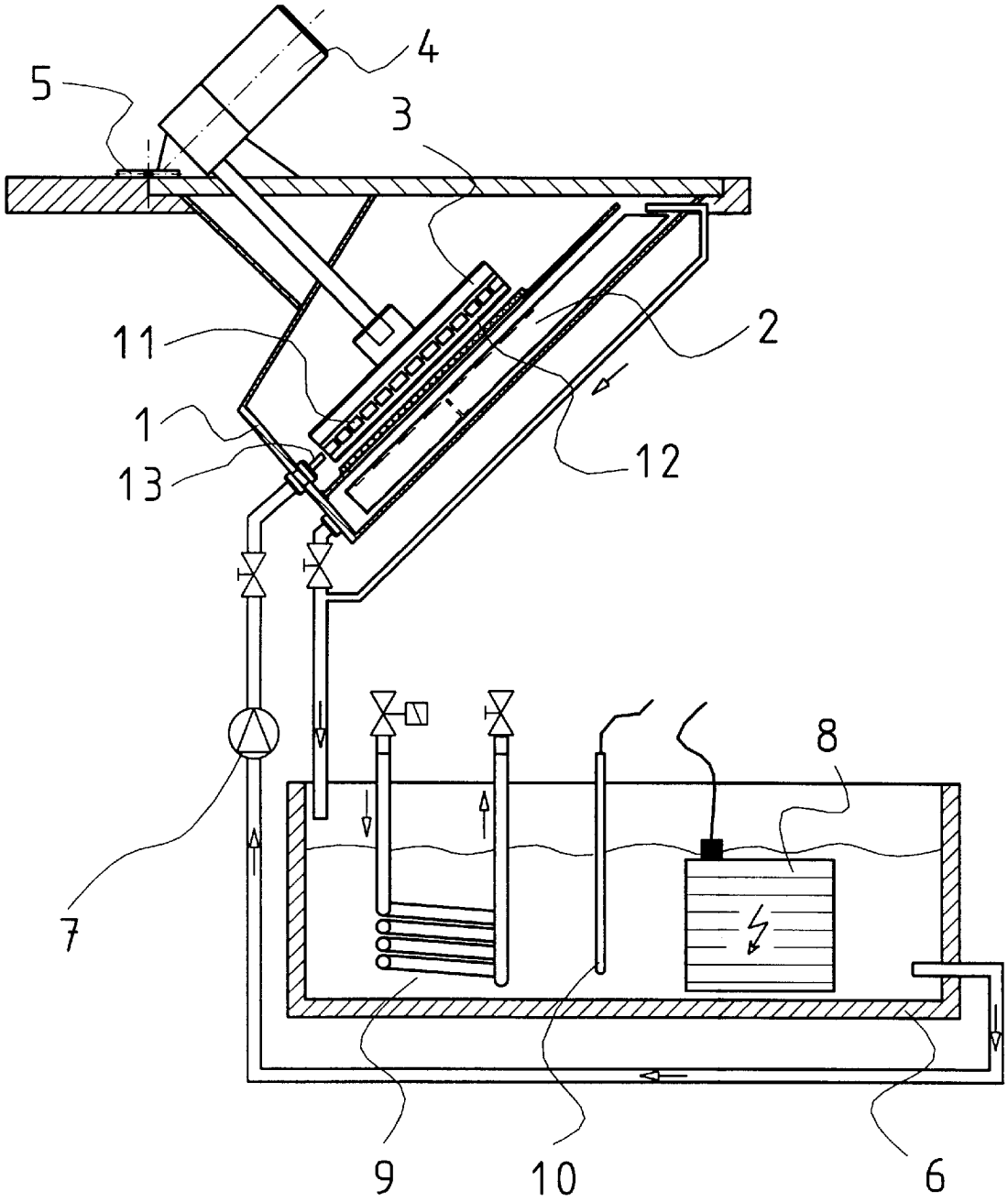
FIG. 1 is a schematic part-sectional view of an electroforming apparatus made in accordance with the invention.

Reference number 1 in FIG. 1 denotes a housing defining an electrolytic deposition chamber therein. The housing 1 is hinged, as indicated at reference number 5, to a framework and can thus be pivoted between an operating position as shown in FIG. 1 and a servicing position (not shown) which it adopts after being rotated counter-clockwise in FIG. 1. A stationary anode assembly comprising an anode basket 2 having a plane upper surface is provided in the deposition chamber. A cathode assembly including a disc-shaped cathode platen 3 is mounted in parallel with and spaced from the anode basket 2 in the deposition chamber for rotating about a shaft. The shaft is connected to a drive means 4 outside of the housing 1 for rotating the cathode platen 3 at a desired rotational speed. The anode basket 2 may be stocked with pellets of e.g. Ni if it is intended to coat a moulding tool blank (shown cross-hatched in FIG. 2) mounted on the cathode platen 3 with Ni.

The cathode platen 3 is connected to the minus pole of a dc voltage source (not-shown) whose plus pole is connected to the anode basket 2 so that a dc current of adjustable strength flows between the anode basket 2 and the cathode platen 3.

A container 6 for storing a suitable quantity of electrolytic fluid is provided outside the housing 1. The electrolytic fluid may be a Ni electrolyte for the case of use in a Ni coating process. A pump 7 is provided in a conduit connected to the storage container 6 and porting into the deposition chamber and is adapted to pump the electrolytic fluid from the storage container 6 into the deposition chamber. The electrolytic fluid pumped into the deposition chamber acumulates at the lowermost part thereof and is returned from there into the storage container 6 via another conduit.

Suitable means, e.g. in the form of an electrical heating means 8 and a cooling means 9 both disposed in the storage container 6 serve for heating or cooling the temperature of the electrolytic fluid in the storage container 6. A temperature sensor 10 is disposed in the storage container 6 for outputting a signal indicative of the temperature of the electrolytic fluid in the storage container 6 and for supplying the signal to a control means (not-shown) in order to control the heating or cooling means 8, 9 in a manner that the temperature of the electrolytic fluid in the storage container 6 is held at a suitable specified value.

The previously described basic structure of an electroforming apparatus for the manufacture of CD/LD data media moulding tools is known. For further details reference can be made to e.g. J. H. A. Schmitz et al, "Galvanoformung bei der Herstellung von Bildplatten", Galvanotechnik, Vol 77, 1986, pages 61–63.

As can be seen from FIG. 1, in accordance with the present invention, a plurality of radial flow passages 11 extend through a tubular or annular part 12 protruding from the cathode platen 3. The flow passages 11 have external inlet ends or openings at the outer periphery of the tubular part 12 and are disposed in equal angular spacing from each other. A nozzle means 13 connected to the pump 7 and supplied by it with electrolytic fluid is mounted stationary on the housing 1. The nozzle means 13 is held spaced from the outer periphery of the tubular part 12 and in alignment with the inlet ends of the flow passages 11, thereby a jet of electrolytic fluid ejected from the nozzle means 13 can be received substantially in toto by the flow passages 11 when the inlet ends thereof are successively moved past the nozzle means 13 during the rotation of the cathode platen 3. The electrolytic fluid introduced into the inlet ends flows through the flow passages 11 and leaves the flow passages 11 at the internal outlet ends thereof from which the electrolytic fluid flows into the narrow space between the cathode platen 3 and the anode basket 2. The electrolytic fluid acts in this space as a conductive medium for the migration of ions induced by the electrical potential applied to the cathode platen 3 and anode basket 2.

Accordingly, a feature of the invention is that the electrolytic fluid is guided via the flow passages 11 in the tubular part 12 into the space between the cathode platen 3 and the anode basket 2 so that the spacing between the cathode platen 3 and the anode basket 2 can be substantially reduced in relation to a spacing having been necessary until now for accommodating a nozzle means in the space between the cathode platen 3 and the anode basket 2. In practice, the spacing is virtually limited only by the need to maintain freedom of rotation of the cathode platen 3 with the moulding tool blank mounted thereon.

Preferably, each flow passage 11 is radially or essentially radially aligned with regard to the rotational axis of the cathode platen 3 and has a cross-sectional configuration which tapers from the inlet towards the outlet ends. In this case each flow passage 11 will eject the electrolytic fluid radially from its internal outlet end like a nozzle. If desired, the flow passages 11 could have other suitable alignment and cross-sectional configuration. They may e.g. be designed such that the electrolytic fluid ejected from the nozzle means 13 and received by the flow passages 11 exerts a circumferential component of force on the tubular part 12 like a turbine so that the cathode platen 3 is rotated by the kinetic energy of the electrolytic fluid flowing through the flow passages 11. In such case a separate drive means 4 for rotating the cathode platen 3 can eventually be omitted.

As mentioned, the flow passages 11 are provided in a tubular part 12 which may be an axial integral extension of the cathode platen 3 extending by a suitable amount beyond the moulding tool blank supporting face of the cathode platen 3 so that the moulding tool blank at its outer periphery is fully surrounded by the tubular part 12.

Figure 3:
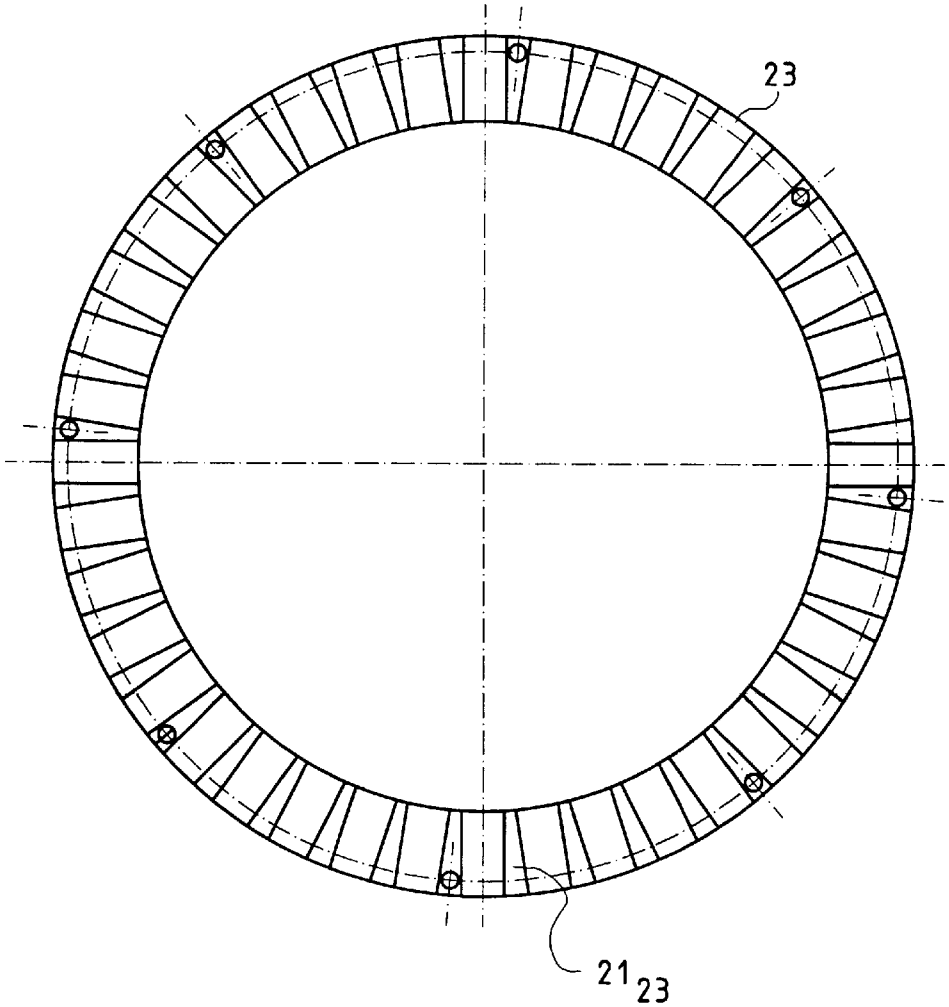
FIG. 3 is a view along dividing plane III—III of FIG. 2.
Figure 2:
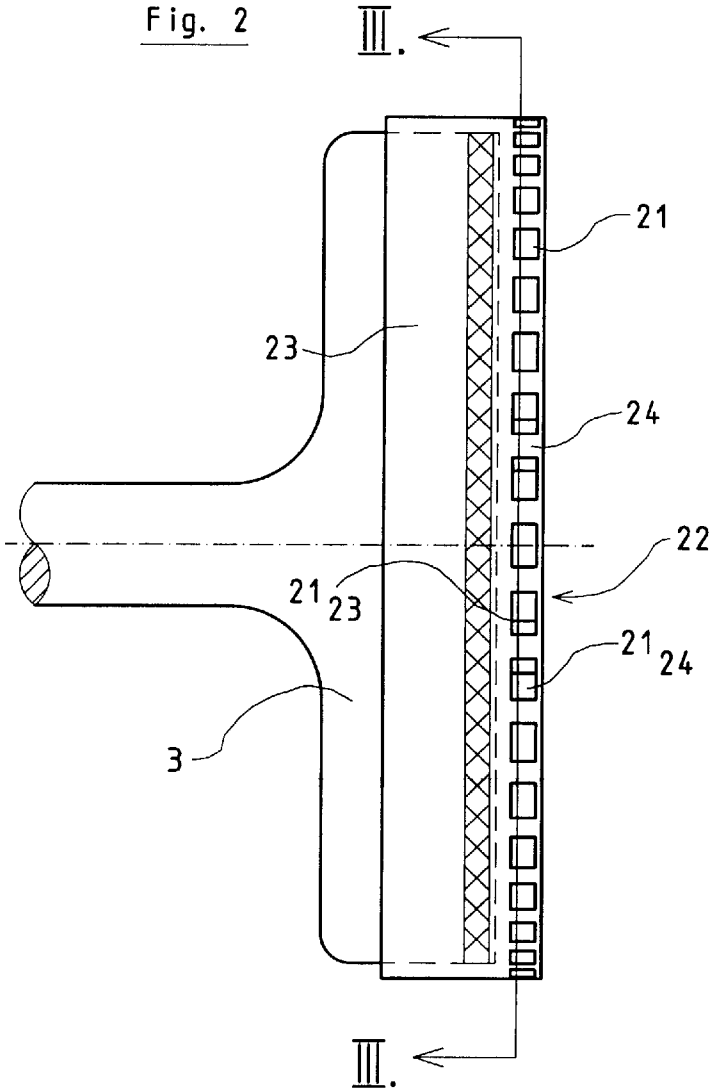
FIG. 2 is a schematic view of a cathode assembly of the electroforming apparatus according to FIG. 1 incorporating a modified embodiment of a carrier ring of the fluid passages.

A modified embodiment of the tubular part having the flow passages therein is shown in FIGS. 2 and 3. The modified tubular part bears the reference number 22 and is constructed as a separate mounting or retaining ring which can be fixed e.g. screwing to the cathode assembly or platen 3. The retaining ring 22 serves for mounting the moulding tool blank to the cathode platen 3. e.g. by clamping it between the retaining ring 22 and the supporting face of the cathode platen 3.

Although the retaining ring 22 may be an integral part, a two-piece struture for the retaining ring 22 is preferred having inner and outer ring sections 23 and 24 which abut in a radial plane crossing the flow passages 21. The sections can be connected to each other by suitable means e.g. by welding or bolts. Matching radial grooves or recesses $\mathbf{21}_{23}$ and $\mathbf{21}_{24}$ are provided in the opposite abutting faces of the ring sections 23, 24 (only the grooves or recesses $\mathbf{21}_{23}$ in the face of the inner ring section 23 can be seen in FIG. 3). The grooves or recesses $\mathbf{21}_{23}$ and $\mathbf{21}_{24}$ form flow passages 21 similar to those as decribed in connection with the embodiment shown in FIG. 1 after assembly of the sections 23 and 24 as can be seen in FIG. 2.

The integral mounting or retaining ring 22 or the ring sections 23, 24 preferably are moulded of a suitable, chemically resistant plastic material. Other materials, however, can also be used, if desired.

The invention has been described above with reference to a nozzle means in the form of a single nozzle. However, the nozzle means may also comprise a plurality of nozzles which may be arranged along the periphery of the annular part 12 or 22 so that several flow passages 11, 21 are always supplied with electrolytic fluid at the same time.

Although particular preferred embodiments of the invention have been disclosed in detail for illustrative purposes, it will be recognised that variations or modifications of the embodiments which become apparent for a person skilled in the art when reading the present disclosure can be made without departing from the spirit of the present invention.

What is claimed is:

1. An electroforming apparatus, including an anode assembly and a rotable cathode assembly spaced from each other, and a stationary nozzle means for ejecting an electrolytic fluid for introducing it into a space between the anode and cathode assemblies for coating a moulding tool blank adapted for mounting on the cathode assembly, wherein a plurality of flow passages extend through an annular part provided on said cathode assembly adapted to surround the moulding tool blank when mounted on the cathode assembly, said flow passages being circumferentially spaced from each other and, at the outer periphery of said annular part, having external inlet ends oriented with respect to said nozzle means such that the inlet ends successively come into alignment with the nozzle means upon rotation of the cathode assembly so that the electrolytic fluid ejected from the nozzle means is substantially received in the flow passages and guided by the flow passages into the space between the anode and cathode assemblies.

2. The apparatus of claim 1 wherein the flow passages are substantially radially aligned.

3. The apparatus of claim 1 wherein the annular part is a mounting ring adapted to be fixed to the cathode assembly for mounting the moulding tool blank thereto.

4. The apparatus of claim 3 wherein the mounting ring is composed of a pair of sections having faces with similar grooves formed therein, said grooves of one of the sections and the aligned grooves of the other section forming said flow passages upon assembly of said sections.

5. The apparatus of claim 3 wherein the mounting ring is formed of a plastic material.

6. The apparatus of claim 1 wherein at least some of said flow passages have cross-sections tapering along at least part of the length of the flow passages from the inlet to oulet ends thereof.

7. The apparatus of claim 1 wherein at least one of said nozzle means and flow passages is arranged that the electrolytic fluid flowing through the flow passages exerts a rotational force to the cathode assembly.

* * * * *